US009243800B2

(12) United States Patent
Goodson et al.

(10) Patent No.: US 9,243,800 B2
(45) Date of Patent: Jan. 26, 2016

(54) APPARATUS FOR ELECTRODYNAMICALLY DRIVING A CHARGED GAS OR CHARGED PARTICLES ENTRAINED IN A GAS

(75) Inventors: David B. Goodson, Seattle, WA (US); Thomas S. Hartwick, Snohomish, WA (US); Tracy A. Prevo, Seattle, WA (US); Joseph Colannino, Mercer Island, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 999 days.

(21) Appl. No.: 13/370,280

(22) Filed: Feb. 9, 2012

(65) Prior Publication Data

US 2013/0004902 A1 Jan. 3, 2013

Related U.S. Application Data

(60) Provisional application No. 61/441,229, filed on Feb. 9, 2011.

(51) Int. Cl.

| | |
|---|---|
| ***F23N 5/00*** | (2006.01) |
| ***F23N 5/26*** | (2006.01) |
| ***F23D 14/84*** | (2006.01) |
| ***F23C 5/14*** | (2006.01) |
| ***F23C 99/00*** | (2006.01) |

(52) U.S. Cl.

CPC . *F23N 5/265* (2013.01); *F23C 5/14* (2013.01); *F23C 99/001* (2013.01); *F23D 14/84* (2013.01)

(58) Field of Classification Search

CPC ..... F23D 14/84; F23N 5/265; F23C 99/001; F23C 5/14

See application file for complete search history.

(56) References Cited

U.S. PATENT DOCUMENTS

| | | | |
|---|---|---|---|
| 2,604,936 | A | 7/1952 | Kaehni et al. |
| 3,306,338 | A | 2/1967 | Wright et al. |
| 3,358,731 | A | 12/1967 | Donnelly |
| 3,416,870 | A | 12/1968 | Wright |
| 4,091,779 | A | 5/1978 | Saufferer et al. |
| 4,093,430 | A | 6/1978 | Schwab et al. |
| 4,110,086 | A | 8/1978 | Schwab et al. |
| 4,111,636 | A | 9/1978 | Goldberg |
| 4,675,029 | A | 6/1987 | Norman et al. |
| 5,702,244 | A | 12/1997 | Goodson et al. |
| 6,640,549 | B1 | 11/2003 | Wilson et al. |
| 6,742,340 | B2 | 6/2004 | Nearhoof, Sr. et al. |
| 6,887,069 | B1 | 5/2005 | Thornton et al. |
| 7,137,808 | B2 | 11/2006 | Branston et al. |

(Continued)

FOREIGN PATENT DOCUMENTS

| | | |
|---|---|---|
| WO | WO 96/01394 | 1/1996 |

OTHER PUBLICATIONS

F. Altendorfner et al., Electric Field Effects on Emissions and Flame Stability with Optimized Electric Field Geometry, The European Combustion Meeting EMC 2007, 2007, 1-6, Germany.

(Continued)

*Primary Examiner* — Alfred Basichas

(74) *Attorney, Agent, or Firm* — Christopher A. Wiklof; Nicholas S. Bromer; Launchpad IP, Inc.

(57) ABSTRACT

Gaseous particles or gas-entrained particles may be conveyed by electric fields acting on charged species included in the gaseous or gas-entrained particles.

17 Claims, 5 Drawing Sheets

(56) References Cited

U.S. PATENT DOCUMENTS

| | | | | |
|---|---|---|---|---|
| 7,243,496 | B2 | 7/2007 | Pavlik et al. | |
| 7,377,114 | B1 | 5/2008 | Pearce | |
| 7,523,603 | B2 | 4/2009 | Hagen et al. | |
| 7,845,937 | B2 | 12/2010 | Hammer et al. | |
| 7,927,095 | B1 | 4/2011 | Chorpening et al. | |
| 8,082,725 | B2 | 12/2011 | Younsi et al. | |
| 8,245,951 | B2 | 8/2012 | Fink et al. | |
| 2003/0080294 | A1* | 5/2003 | Matocha et al. | 250/339.15 |
| 2005/0208442 | A1 | 9/2005 | Heiligers et al. | |
| 2007/0020567 | A1 | 1/2007 | Branston et al. | |
| 2010/0183424 | A1 | 7/2010 | Roy | |
| 2011/0027734 | A1 | 2/2011 | Hartwick et al. | |
| 2011/0203771 | A1 | 8/2011 | Goodson et al. | |
| 2012/0276487 | A1 | 11/2012 | Hangauer et al. | |
| 2012/0317985 | A1 | 12/2012 | Hartwick et al. | |
| 2013/0004902 | A1 | 1/2013 | Goodson et al. | |
| 2013/0071794 | A1 | 3/2013 | Colannino et al. | |
| 2013/0170090 | A1 | 7/2013 | Colannino et al. | |
| 2013/0230810 | A1 | 9/2013 | Goodson et al. | |
| 2013/0230811 | A1 | 9/2013 | Goodson et al. | |
| 2013/0255482 | A1 | 10/2013 | Goodson | |
| 2013/0255548 | A1 | 10/2013 | Goodson et al. | |
| 2013/0255549 | A1 | 10/2013 | Sonnichsen et al. | |
| 2013/0260321 | A1 | 10/2013 | Colannino et al. | |

OTHER PUBLICATIONS

Altendrfner et al., "Electric Field Effects on Emissions and Flame Stability With Optimized Electric Field Geometry", Third European Combustion Meeting ECM 2007, p. 1-6.

William T. Brande; "The Bakerian Lecture: On Some New Electro-Chemical Phenomena", Phil. Trans. R. Soc. Lond. 1814 104, p. 51-61.

* cited by examiner

APPARATUS FOR ELECTRODYNAMICALLY DRIVING A CHARGED GAS OR CHARGED PARTICLES ENTRAINED IN A GAS

CROSS-REFERENCE TO RELATED APPLICATIONS

The present application claims priority benefit under 35 USC §119(e) to U.S. Provisional Application Ser. No. 61/441,229; entitled "ELECTRIC FIELD CONTROL OF TWO OR MORE RESPONSES IN A COMBUSTION SYSTEM", invented by Thomas S. Hartwick, et al.; filed on Feb. 9, 2011; which is co-pending herewith at the time of filing, and which, to the extent not inconsistent with the disclosure herein, is incorporated by reference.

The present application is related to U.S. Non-Provisional patent application Ser. No. 13/370,183; entitled "ELECTRIC FIELD CONTROL OF TWO OR MORE RESPONSES IN A COMBUSTION SYSTEM", invented by Thomas S. Hartwick, et al.; filed on the same day as this application and which, to the extent not inconsistent with the disclosure herein, is incorporated by reference.

The present application is related to U.S. Non-Provisional patent application Ser. No. 13/370297; entitled "METHOD AND APPARATUS FOR FLATTENING A FLAME", invented by Joseph Colannino, et al.; filed on the same day as this application and which, to the extent not inconsistent with the disclosure herein, is incorporated by reference.

SUMMARY

According to an embodiment, a system for synchronously driving a flame shape or heat distribution may include a charge electrode configured to impart transient majority charges onto a flame, a plurality of field electrodes or electrode portions configured to apply electromotive forces onto the transient majority charges, and an electrode controller operatively coupled to the charge electrode and the plurality of field electrodes or electrode portions, the electrode controller being configured to cause synchronous transport of the transient majority charges by the electromotive forces applied by the plurality of field electrodes or electrode portions.

According to another embodiment, a method for transporting chemical reactants or products in a gas phase or gas-entrained chemical reaction may include causing a charge imbalance among gaseous or gas-entrained charged species associated with a chemical reaction and applying a sequence of electric fields to move the charge-imbalanced gaseous or gas-entrained charged species across a distance from a first location to a second location separated from the first location.

DETAILED DESCRIPTION

Figure 1A:
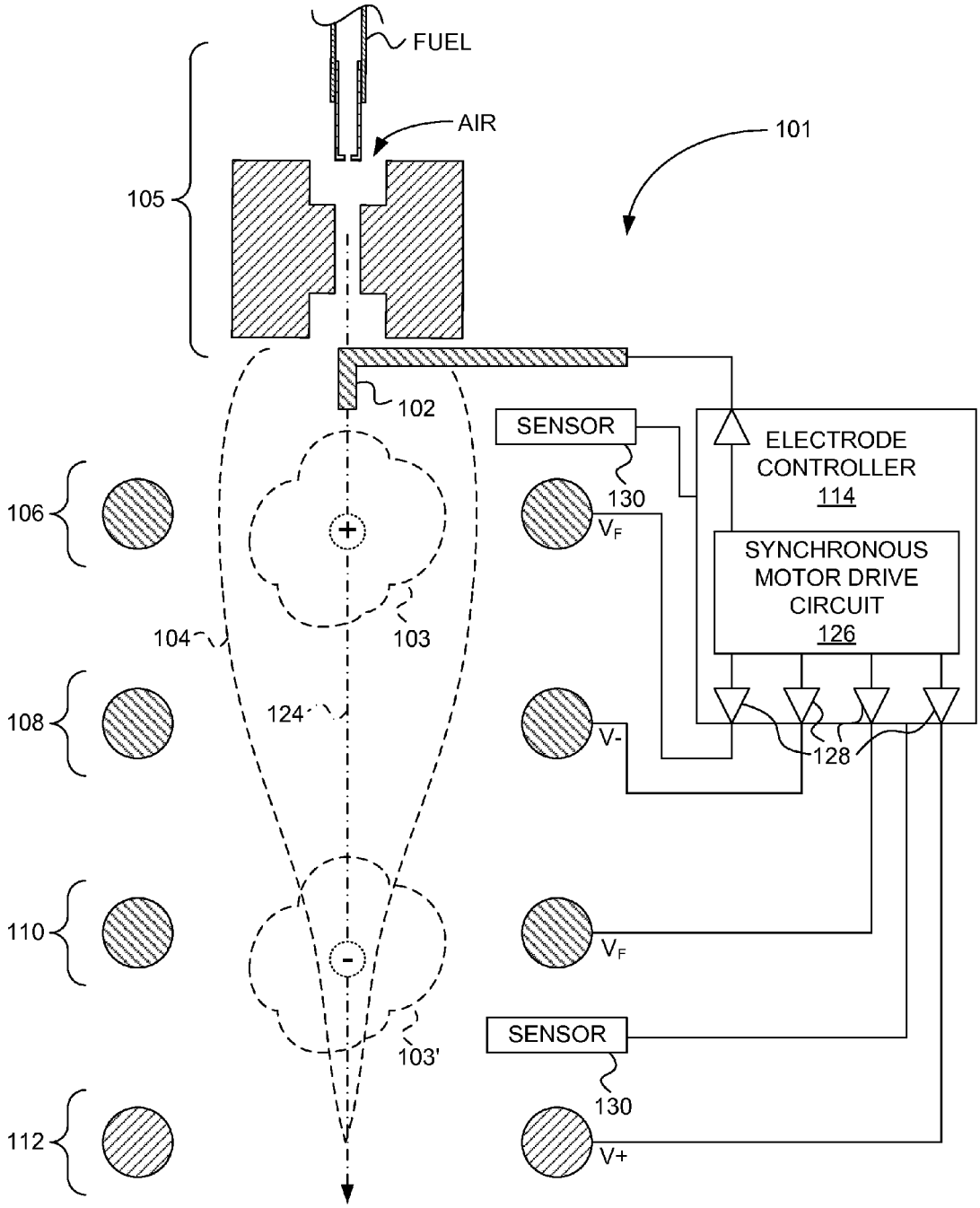
FIG. 1A is a diagram showing a system 101 configured to synchronously drive a flame shape or heat distribution, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

FIG. 1A is a diagram showing a system 101 configured to synchronously drive a flame shape or heat distribution, according to an embodiment. A charge electrode 102 may be configured to impart transient majority charges 103, 103' onto a flame 104 supported by a burner 105. A plurality of field electrodes 106, 108, 110, 112 or electrode portions may be configured to apply electromotive forces onto the transient majority charges 103, 103'. An electrode controller 114 may be operatively coupled to the charge electrode 102 and the plurality of field electrodes 106, 108, 110, 112 or electrode portions to cause synchronous transport of the transient majority charges 103, 103' by the electromotive forces applied by the plurality of field electrodes 106, 108, 110, 112 or electrode portions.

The charge electrode 102 may include a charge injector (not shown) configured to add the transient majority charges 103, 103' to the flame 104. Alternatively or additionally, the charge electrode 102 may include a charge depletion surface (not shown) configured to remove transient minority charges from the flame 104 to leave the transient majority charges 103, 103' in the flame 104.

As shown in FIG. 1A, the field electrodes may include a plurality of independently driven electrodes 106, 108, 110, 112.

Figure 1B:
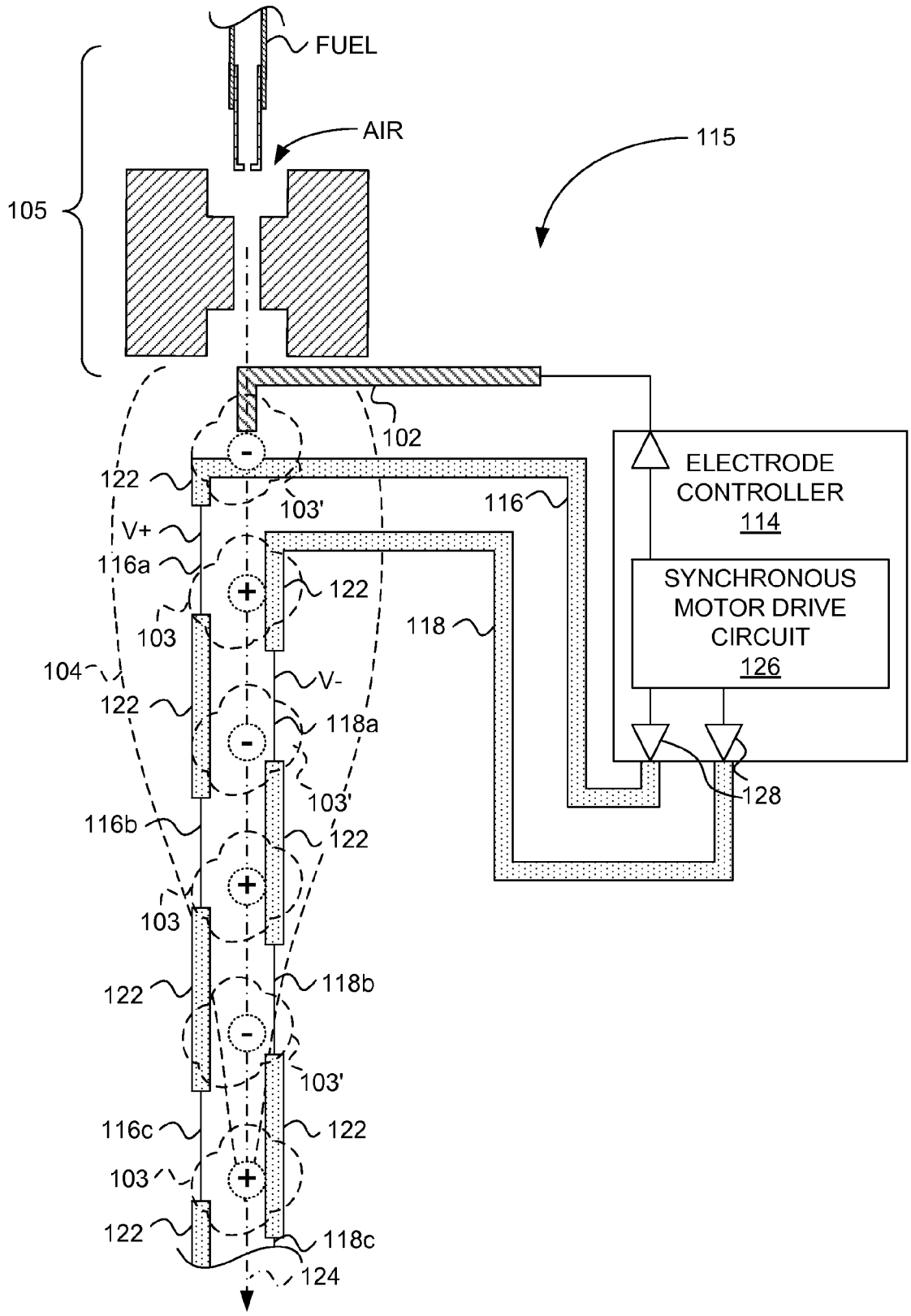
FIG. 1B is a diagram showing a system 115 having an alternative electrode arrangement, according to an embodiment.

Alternatively, the field electrodes may be provided as electrode portions. For example, FIG. 1B is a diagram showing a plurality of electrodes 116, 118 each including a plurality of electrode portions (respectively 116*a*, 116*b*, 116*c*; 118*a*, 118*b*, 118*c*), according to an embodiment. The electrode portions 116*a*, 116*b*, 116*c*; 118*a*, 118*b*, 118*c* of each electrode 116, 118 may be separated from one another by shielded portions 122. The shielded portions 122 may include a first insulator layer peripheral to the electrode (not shown), an electrical shield conductor (not shown) peripheral to the first insulator layer, and a second insulator layer (not shown) peripheral to the shield conductor. The permittivity and/or dielectric strengths of the first and second insulator layers may be balanced such that minimum image charge is exposed to the passing transient majority charges 103, 103' by the shielded portions 122, thus allowing the transient majority charges 103, 103' to substantially receive attraction and repulsion only from the unshielded plurality of electrode portions 116*a-c*, 118*a-c*.

Various arrangement of electrodes or electrode portion arrangements are contemplated, such as outside-in, inside-out, diverging paths, converting paths, substantially axial, substantially peripheral, for example. As may be appreciated by inspection of FIG. 1A, the electrodes 106, 108, 110, 112 may be formed as or include a series of toruses (as depicted) or toroids. The toroids may have a variable aperture size. At aperture sizes that are relatively large compared to flame 104 diameter, the configuration 101 may be regarded as outside-disposed ("outside-in") electrodes. In comparison, the arrangement 115 of FIG. 1B is intended to represent interdigitally arranged, common-phase electrodes formed as tungsten wires including interdigitated shielded regions 122. According to an embodiment, the wires may be disposed as close as practicable to a transport axis 124. In such an arrangement 115, the electrodes may be regarded as inside-disposed ("inside-out") electrodes. In some embodiments, the wires may be end-loaded as an unwind-rewind "web" configured to be paid through (moved parallel to the transport path 124) as desired to change region pitch, renew a degradable surface, facilitate overhaul, etc.

Referring to FIG. 1B, the field electrodes 116, 118, or electrode portions 116*a-c*, 118*a-c* are shown arranged along and within a transport path 124. This may be compared to FIG. 1A, where the field electrodes 106, 108, 110, 112 may be seen to be arranged along and peripheral to (e.g. outside a typical flame radius from) the transport path 124. Referring generally to FIGS. 1A and 1B, the electromotive forces applied by the electrodes 106, 108, 110, 112 on the transient majority charges 103, 103' may impart momentum transfer onto uncharged gas particles or gas-entrained particles included with the charged particles in the clouds 103, 103'. For example, a mechanism akin to the cascade described in FIG. 2 and corresponding portions of the detailed description of the copending provisional patent application Ser. No. 61/506,332, entitled "Gas Turbine with Coulombic Protection from Hot Combustion Products", incorporated herein by reference, may convey inertia from the accelerated charged particles to uncharged particles. "Particles" may refer to any gas molecule, nucleus, electrons, agglomeration, or other structure included in or entrained by flow through or peripheral to the flame 104. According to an embodiment the electrode controller 114 may be configured to cause the charge electrode 102 to impart transient majority charges 103, 103' corresponding to a sequence of oppositely charged majority charged regions shown as clouds 103, 103' in FIGS. 1A and 1B. The electrode controller 114 may also be configured to apply sequences of voltages to the plurality of field electrodes 106, 108, 110, 112 or electrode portions 116*a-c*, 118*a-c* to drive movement of the oppositely charged majority charged regions along a transport path 124. Referring to FIG. 1A, for example, a positive transient majority charge region 103 may be attracted downward by a negative voltage applied to the field electrode 108. Similarly, a negative transient majority charge region 103' may be attracted downward by a positive voltage applied to the field electrode 112. The negative transient majority charge region 103' may also be repelled downward by the negative voltage applied to the field electrode 108. As the charged regions 103, 103' move downward along the transport path 124, the voltages on the electrodes 106, 108, 110, 112 may be synchronously changed with the movement to maintain a moving electromotive force akin to a type of electrostatically driven linear stepper motor or linear synchronous motor. Simultaneously, the voltage applied to the charge electrode 102 may be switched to cause continued generation of additional charged regions 103', 103. Referring to FIG. 1B, for example, positive transient majority charge regions 103 may be attracted downward by a negative voltage applied to the electrode portions 118*a*, 118*b*, 118*c*. Simultaneously, the negative voltage electrode portions 118*a*, 118*b*, 118*c*, may repel negative transient majority charge regions 103' downward. At the same time, positive transient majority charge regions 103 may be repelled downward by a positive voltage applied to the positive voltage electrode portions 116*a*, 116*b*, 116*c* while the negative transient majority charge regions 103' are attracted downward by the positive voltage electrode portions 116*a*, 116*b*, 116*c*. As the charged regions 103, 103' move downward along the transport path 124, the voltages on the electrodes 116, 118 (and respective corresponding electrode portions 116*a-c*, 118*a-c*) may be synchronously changed with the movement to maintain a moving electromotive force akin to a type of electrostatically driven linear stepper motor or linear synchronous motor. Simultaneously, the voltage applied to the charge electrode 102 may be switched to cause continued generation of additional charged regions 103', 103.

Figure 2:
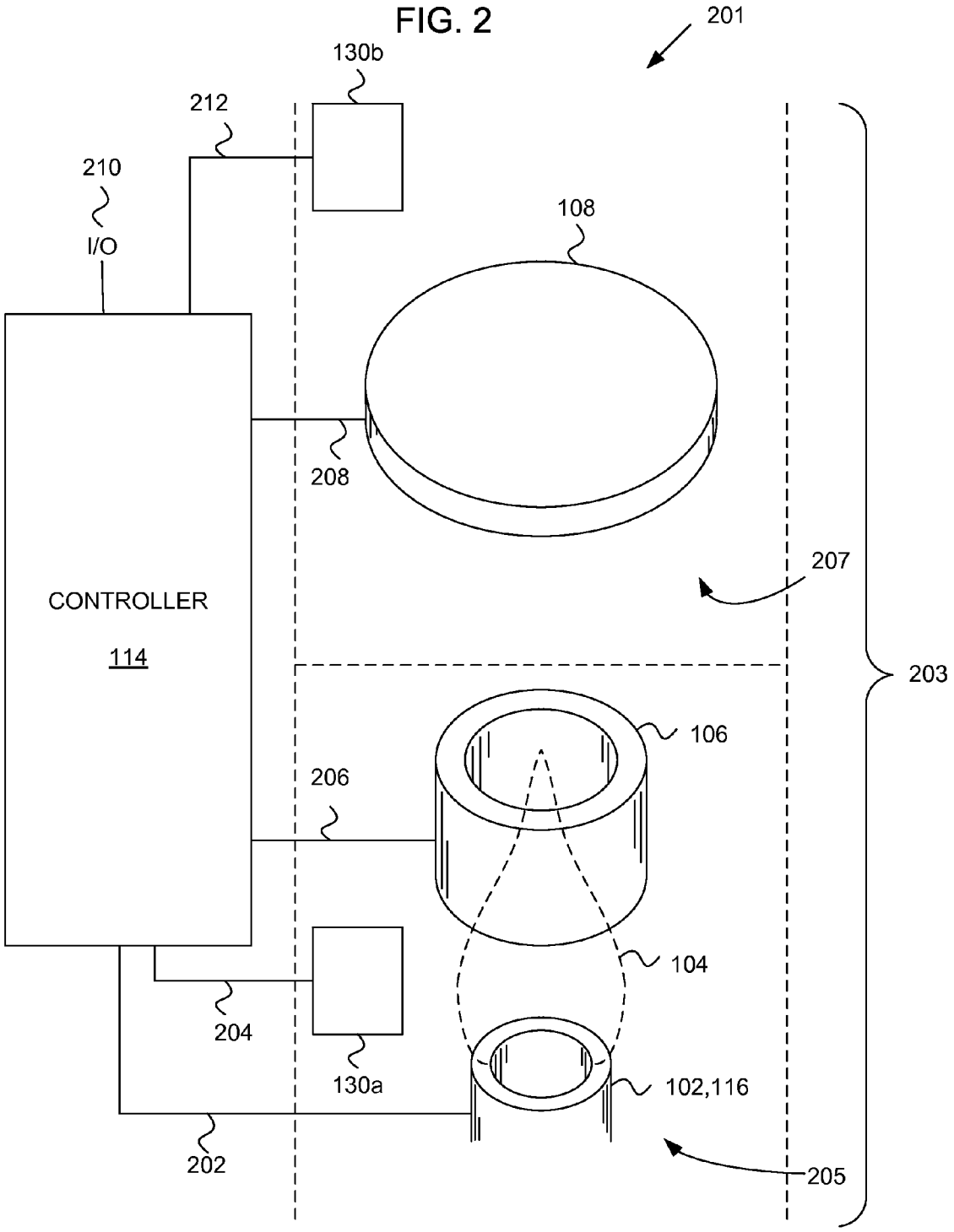
FIG. 2 is a diagram showing a system including sensors configured to provide feedback signals to an electrode controller, according to an embodiment.

Referring to FIGS. 1A and 1B, the electrode controller 114 may further include a synchronous motor drive circuit 126 configured to generate drive pulses corresponding to voltages applied to the plurality of field electrodes 106, 108, 110, 112 or electrode portions 116*a-c*, 118*a-c*. The electrode controller 114 may have one or more amplifiers 128 configured to amplify drive pulses to voltages applied to the plurality of field electrodes 106, 108, 110, 112 or electrode portions 116*a-c*, 118*a-c*. The one or more amplifiers may include a separate amplifier for each independently controlled field electrode 106, 108, 110, 112 plus the charge electrode 102. Alternatively, the one or more amplifiers may include a separate amplifier for each conductor 116, 118 corresponding to a group of commonly switched electrode portions 116*a-c*, 118*a-c* plus the charge electrode 102. Optionally, a system 115 may include fewer or more than two groups of electrode portions 116*a-c*, 118*a-c*. In some embodiments, the arrangements 101, 115 may be regarded as a type of linear stepper motor with electrostatic drive. The electrodes may be operated according to a single-step, super-step, micro-step, or other sequence logic, for example. Referring to FIG. 2, embodiments may include one or more sensors 130*a*, 130*b* operatively coupled to provide one or more signals to the electrode controller 114. The one or more sensors 130 may be configured to sense one or more parameters corresponding to one or more of flame shape, heat distribution, combustion characteristic, particle content, or majority charged region location. The electrode controller 114 may be configured to select a timing, sequence, or timing and sequence of drive pulses corresponding to voltages applied to the charge electrode 102, the field electrode 106, 108, 110, 112 or electrode portions 116*a-c*, 118*a-c*, or the charge electrode 102 and the field electrode 106, 108, 110, 112 or electrode portions 116*a-c*, 118*a-c* responsive to the one or more signals from the one or more sensors 130*a*, 130*b*. According to some embodiments, the (optional) sensor(s) 130*a*, 130*b* may be regarded as a portion of a type of servo that provides closed loop control of the synchronous drive circuit 126 shown in FIGS. 1A, 1B.

Still referring to FIG. 2, at least one first sensor 130*a* may be disposed to sense a condition in a region 205 of a combustion volume 203 proximate the flame 104 supported by the burner 105. The first sensor(s) 130*a* may be operatively coupled to the electronic controller 114 via a first sensor signal transmission path 204. The first sensor(s) 130*a* may be configured to sense a combustion parameter of the flame 104. For example, the first sensor(s) 130*a* may include one or more of a flame luminance sensor, a photo-sensor, an infrared sensor, a fuel flow sensor, a temperature sensor, a flue gas temperature sensor, an acoustic sensor, a CO sensor, an $O_2$ sensor, a radio frequency sensor, and/or an airflow sensor.

At least one second sensor 130*b* may be disposed to sense a condition distal from the flame 104 and operatively coupled to the electronic controller 114 via a second sensor signal transmission path 212. The at least one second sensor 130*b* may be disposed to sense a parameter corresponding to a condition in the second portion 207 of the combustion volume 203. For example, for an embodiment where the second portion 207 includes a pollution abatement zone, the second sensor may sense optical transmissivity corresponding to an amount of ash present in the second portion 207 of the heated volume 203. According to various embodiments, the second sensor(s) 130*b* may include one or more of a transmissivity sensor, a particulate sensor, a temperature sensor, an ion sensor, a surface coating sensor, an acoustic sensor, a CO sensor, an $O_2$ sensor, and an oxide of nitrogen sensor.

According to an embodiment, the second sensor 130*b* may be configured to detect unburned fuel. The at least one second electrode 108 may be configured, when driven, to force unburned fuel downward and back into the first portion 205 of the heated volume 203. For example, unburned fuel may be positively charged. When the second sensor 130*b* transmits a signal over the second sensor signal transmission path 212 to the controller 114, the controller may drive the second electrode 108 to a positive state to repel the unburned fuel. Fluid flow within the heated volume 203 may be driven by electric field(s) formed by the at least one second electrode 108 and/or the at least one first electrode 106 to direct the unburned fuel downward and into the first portion 205, where it may be further oxidized by the flame 104, thereby improving fuel economy and reducing emissions.

Figure 4:
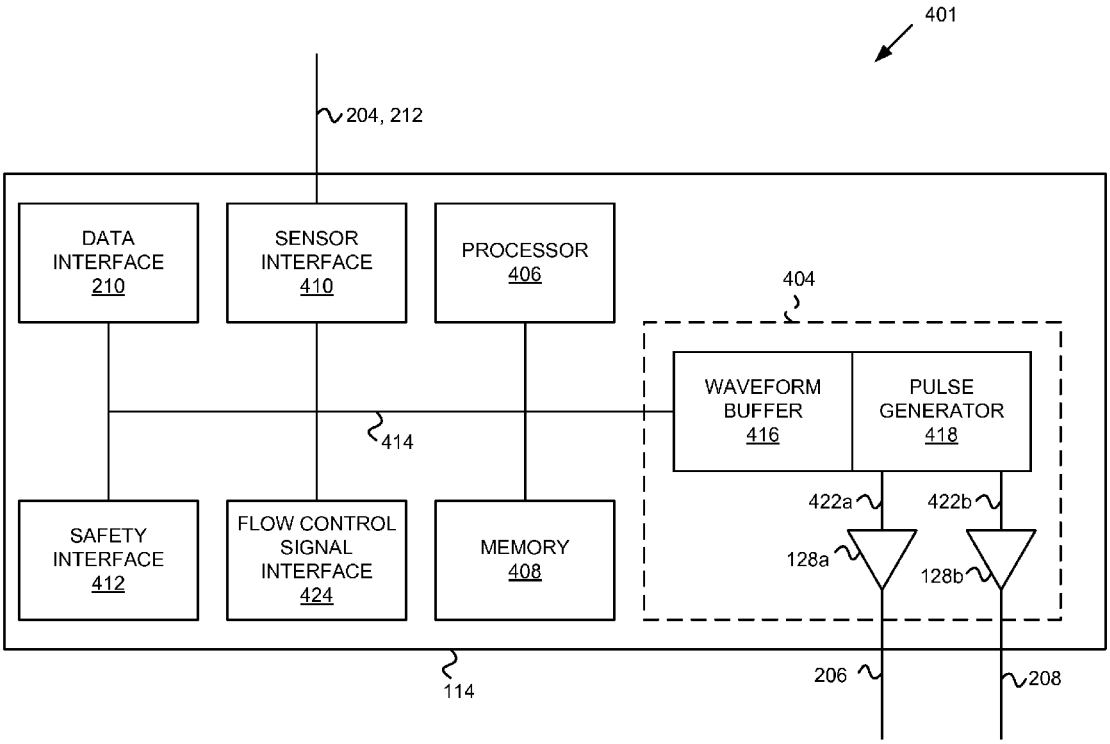
FIG. 4 is a block diagram of an electrode controller, according to an embodiment.

The controller 114 may include a communications interface 210 configured to receive at least one input variable to control responses to the sensor(s) 130*a*, 130*b*. Additionally or alternatively, the communication interface 210 may be configured to receive at least one input variable to control electrode drive waveform, voltage, relative phase, or other attributes of the system. An embodiment of the controller 114 is shown in FIG. 4 and is described below.

Figure 3:
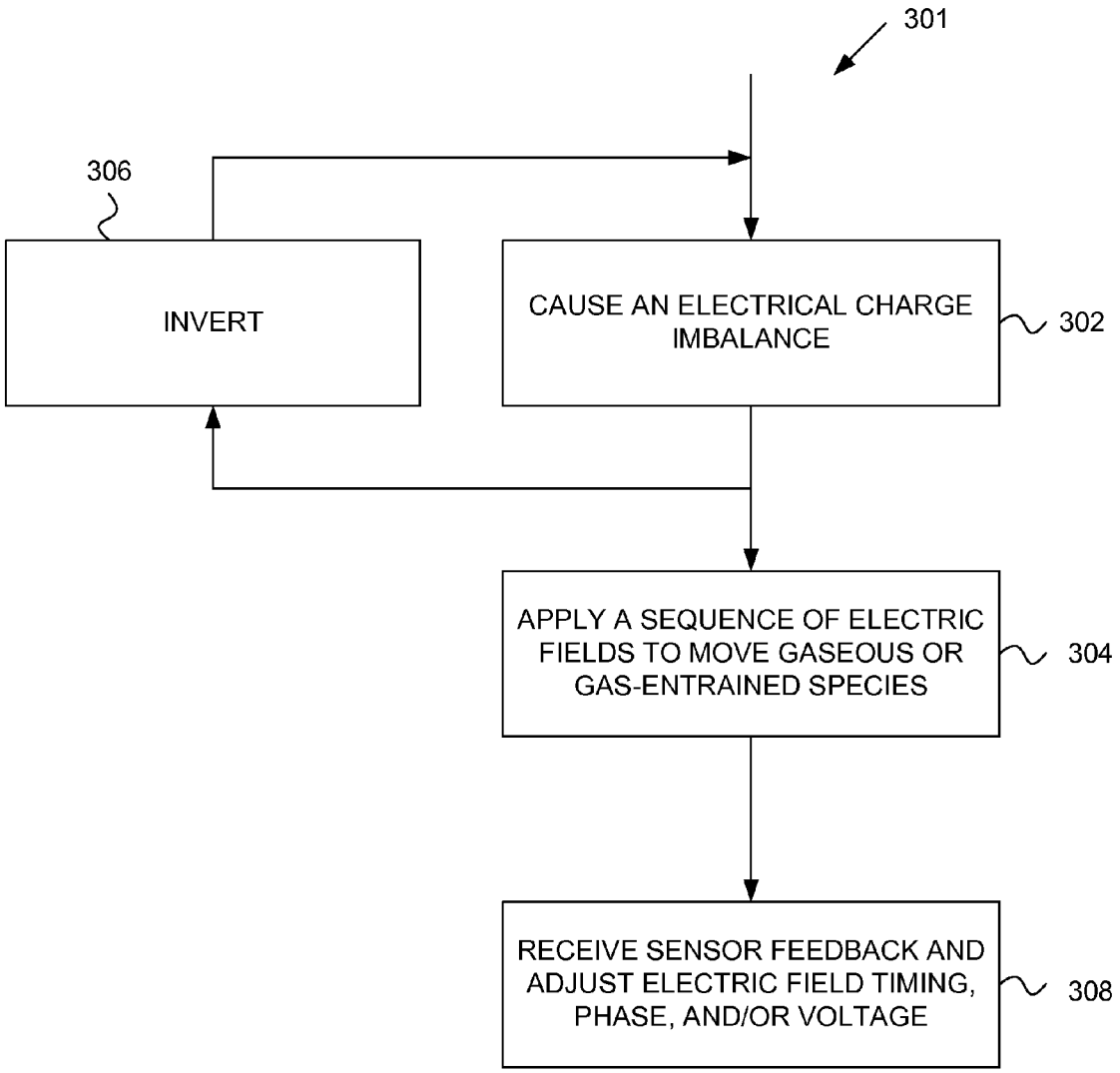
FIG. 3 is a flow chart showing a method for transporting chemical reactants or products in a gas phase or gas-entrained chemical reaction, according to an embodiment.

FIG. 3 is a flow chart illustrating a method 301 for transporting chemical reactants or products in a gas phase or gas-entrained chemical reaction, according to an embodiment. The chemical reactants or products in a gas phase or gas-entrained chemical reactants may be transported by first performing step 302, wherein a charge imbalance is caused among gaseous or gas-entrained charged species associated with a chemical reaction. Proceeding to step 304, a sequence of electric fields may be applied to move the charge-imbalanced gaseous or gas-entrained charged species across a distance from a first location to a second location separated from the first location. The movement of the charge-imbalanced gaseous or gas-entrained charged species may impart inertia on non-charged species associated with or proximate to the chemical reaction to move the non-charged species across the distance. The chemical reaction may include an exothermic reaction such as a combustion reaction. The movement of the charge-imbalanced gaseous or gas-entrained charged species may cause heat evolved by the exothermic chemical reaction to be moved across the distance. The method 301 may be used to move heated particles across a distance transverse to or in opposition to buoyancy forces on the heated particles.

Referring to step 302, causing an electrical charge imbalance may include attracting a portion of charged particles having a second charge sign out of the chemical reaction to leave a majority of charged particles having a first charge sign opposite to the second charge sign. Additionally or alternatively, causing a charge imbalance among gaseous or gas-entrained charged species associated with a chemical reaction may include injecting charged particles having a first charge sign into the chemical reaction to provide a majority of charged particles having the first charge sign. The method 301 and step 302 may include causing a majority charge to vary in sign according to a time-varying sequence. As shown in FIG. 3, the process of varying the sign of the charge imbalance may be represented as executing a loop including an inversion step 306. For example, the sign of the charge imbalance may be periodically inverted to produce periodic positive and negative majority charge imbalances. For example, referring to FIGS. 1A and 1B, a periodic waveform may produce a sequence of negatively charged regions 103' interleaved with positively charged regions 103. A combination of inertia, buoyancy forces, and electric field forces may move the sequence of positively and negatively charged regions 103, 103' along the transport path 124.

Referring again to FIG. 3 in view of FIGS. 1A and 1B, applying a sequence of electric fields to move the charge-imbalanced gaseous or gas-entrained charged species across a distance from a first location to a second location separated from the first location may include applying an electric field proximate to the second location or along a transport path between the first location and the second location, applying a sequence of electric fields at locations along a transport path between the first location and the second location and/or applying a sequence of electric fields at each of a plurality of intermediate locations along a transport path between the first location and the second location. Applying a sequence of electric fields at each of a plurality of intermediate locations in step 304 may include applying a first voltage to an electrode or electrode portion at a first intermediate location along the transport path, the first voltage being selected to attract a majority charge carried by the gaseous or gas-entrained charged species and allowing the electrode or electrode portion at the first intermediate location to electrically float or driving the electrode or electrode portion at the first intermediate location to a voltage selected not to attract the majority charge 103, 103' when the gaseous or gas-entrained charged species are near the electrode or electrode portion at the first intermediate location. Step 304 may additionally or alternatively include applying the first voltage to an electrode or electrode portion at a second intermediate location along the transport path when the electrode or electrode portion at the first intermediate location is allowed to electrically float or is driven to a voltage selected not to attract the majority charge, and applying the first voltage to the electrode or electrode portion at the second intermediate location along the transport path to attract the majority charge carried by the gaseous or gas-entrained charged species from the first intermediate location toward the second intermediate location. For example, referring to FIG. 1A, the electrodes 106 and 110 may be allowed to float as the charged region 103, 103' passes by or may be driven to a voltage $V_F$ selected for minimum interaction with the passing charged region 103, 103'. Step 304 may additionally or alternatively include allowing an electrode or electrode portion at a first intermediate location to electrically float or driving the electrode or electrode portion at the first intermediate location to a voltage selected not to attract a majority charge 103,103' when the gaseous or gas-entrained charged species are near the electrode or electrode portion at the first intermediate location; and applying a third voltage to the electrode or electrode portion at the first intermediate location along the transport path when the gaseous or gas-entrained charged species have moved away from the first intermediate location, the third voltage being selected to repel the majority charge 103, 103' carried by the gaseous or gas-entrained charged species. For example, in the embodiment illustrated by FIG. 1A, a negative voltage V− may be placed on electrode 108 to repel the negatively charged region 103' and help push it along the transport path 124.

Step 304 may include applying a sequence of electric fields at each of a plurality of intermediate locations. For example, this may include applying a two phase sequence of electric fields at each of the plurality of intermediate locations. For example, FIG. 1B illustrates a two phase electrode system, wherein each electrode 116, 118 may be sequentially driven positive, float, negative, float, positive, float, negative . . . to drive a sequence of sign-inverted charged regions 103, 103' along the transport path 124.

Step 304 may also be viewed as applying synchronous drive voltages to electrodes or electrode portions at each of the plurality of intermediate locations along the transport path, the synchronous drive voltages being selected to cause movement of packetized charge distributions carried by the gaseous or gas-entrained charged species along the transport path.

Optionally, the method 301 may include step 308 where feedback is received from one or more sensors; and electric field timing, phase, and/or voltage associated with steps 302 and 304 is adjusted. For example, step 308 may include sensing one or more parameters corresponding to a location of a packetized charge distribution along a transport path, and adjusting a voltage corresponding to causing the charge imbalance among gaseous or gas-entrained charged species associated with the chemical reaction. Additionally or alternatively, step 308 may include sensing one or more parameters corresponding to a location of a packetized charge distribution along a transport path, and adjusting a timing or phase corresponding to causing the charge imbalance among gaseous or gas-entrained charged species associated with the chemical reaction. Additionally or alternatively, step 308 may include sensing one or more parameters corresponding to a location of a packetized charge distribution along a transport path, and adjusting a voltage corresponding to applying a sequence of electric fields to move the charge-imbalanced gaseous or gas-entrained charged species. Step 308 may include sensing one or more parameters corresponding to a location of a packetized charge distribution along a transport path, and adjusting a timing or phase corresponding to applying a sequence of electric fields to move the charge-imbalanced gaseous or gas-entrained charged species. Step 308 may additionally or alternatively include determining whether to cause the charge imbalance and move the charge-imbalanced gaseous or gas-entrained charged species.

FIG. 4 is a block diagram of an illustrative embodiment 401 of an electrode controller 114 and/or fuel flow controller 114. The controller 114 may drive the first electrode drive signal transmission paths 206 and 208 to produce electric fields whose characteristics are selected to cause movement of the transient charged regions 103, 103'. The controller may include a waveform generator 404. The waveform generator 404 may be disposed internal to the controller 114 or may be located separately from the remainder of the controller 114. At least portions of the waveform generator 404 may alternatively be distributed over other components of the electronic controller 114 such as a microprocessor 406 and memory circuitry 408. An optional sensor interface 410, communications interface 210, and safety interface 412 may be operatively coupled to the microprocessor 406 and memory circuitry 408 via a computer bus 414.

Logic circuitry, such as the microprocessor 406 and memory circuitry 408 may determine parameters for electrical pulses or waveforms to be transmitted to the electrode(s) via the electrode drive signal transmission path(s) 206, 208. The electrode(s) in turn produce electrical fields corresponding to the voltage waveforms.

Parameters for the electrical pulses or waveforms may be written to a waveform buffer 416. The contents of the waveform buffer may then be used by a pulse generator 418 to generate low voltage signals 422*a*, 422*b* corresponding to electrical pulse trains or waveforms. For example, the microprocessor 406 and/or pulse generator 418 may use direct digital synthesis to synthesize the low voltage signals. Alternatively, the microprocessor 406 may write variable values corresponding to waveform primitives to the waveform buffer 416. The pulse generator 418 may include a first resource operable to run an algorithm that combines the variable values into a digital output and a second resource that performs digital to analog conversion on the digital output.

One or more outputs are amplified by amplifier(s) 128*a* and 128*b*. The amplified outputs are operatively coupled to the electrodes 102, 106, 108, 110, 112, 116, 118 shown in FIGS. 1A, 1B. The amplifier(s) 128*a*, 128*b* may include programmable amplifiers. The amplifier(s) may be programmed according to a factory setting, a field setting, a parameter received via the communications interface 210, one or more operator controls and/or algorithmically. Additionally or alternatively, the amplifiers 128*a*, 128*b* may include one or more substantially constant gain stages, and the low voltage signals 422*a*, 422*b* may be driven to variable amplitude. Alternatively, output may be fixed and the electric fields may be driven with electrodes having variable gain.

The pulse trains or drive waveforms output on the electrode signal transmission paths 206, 208 may include a DC signal, an AC signal, a pulse train, a pulse width modulated signal, a pulse height modulated signal, a chopped signal, a digital signal, a discrete level signal, and/or an analog signal.

According to an embodiment, a feedback process within the controller 114, in an external resource (not shown), in a sensor subsystem (not shown), or distributed across the controller 114, the external resource, the sensor subsystem, and/or other cooperating circuits and programs may control the electrode(s). For example, the feedback process may provide variable amplitude or current signals in the at least one electrode signal transmission path 206, 208 responsive to a detected gain by the at least one first electrode or response ratio driven by the electric field.

The sensor interface 410 may receive or generate sensor data (not shown) proportional (or inversely proportional, geometrical, integral, differential, etc.) to a measured condition in the combustion and/or reaction volume.

The sensor interface 410 may receive first and second input variables from respective sensors 130*a*, 130*b* responsive to physical or chemical conditions in corresponding regions. The controller 114 may perform feedback or feed forward control algorithms to determine one or more parameters for the drive pulse trains, the parameters being expressed, for example, as values in the waveform buffer 416.

Optionally, the controller 114 may include a flow control signal interface 424. The flow control signal interface may be used to generate flow rate control signals to control fuel flow and/or air flow through the combustion system.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A system for synchronously driving a flame shape or heat distribution, comprising:

a charge electrode configured to impart transient majority charges onto a flame;

a plurality of field electrodes or electrode portions configured to apply electromotive forces onto the transient majority charges, the field electrodes or electrode portions being arranged along a transport path of the flame; and an electrode controller operatively coupled to the charge electrode and the plurality of field electrodes or electrode portions, the electrode controller being configured to apply synchronous drive voltages to cause synchronous transport, along the transport path, of the transient majority charges by the electromotive forces applied by the plurality of field electrodes or electrode portions, and thereby synchronously to drive the flame along the transport path.

2. The system for synchronously driving a flame shape or heat distribution of claim 1, further comprising:

a burner configured to support the flame.

3. The system for synchronously driving a flame shape or heat distribution of claim 1, wherein the charge electrode further comprises:

a charge injector configured to add the transient majority charges to the flame.

4. The system for synchronously driving a flame shape or heat distribution of claim 1, wherein the charge electrode further comprises:

a charge depletion surface configured to remove transient minority charges from the flame to leave the transient majority charges in the flame.

5. The system for synchronously driving a flame shape or heat distribution of claim 1, wherein the plurality of field electrodes or electrode portions configured to apply electromotive forces onto the transient majority charges further comprise:

a plurality of independently driven electrodes.

6. The system for synchronously driving a flame shape or heat distribution of claim 1, wherein the plurality of field electrodes or electrode portions configured to apply electromotive forces onto the transient majority charges further comprise:

a plurality of electrodes, each of the plurality of electrodes including a plurality of electrode portions, the electrode portions of each electrode being separated from one another by shielded portions.

7. The system for synchronously driving a flame shape or heat distribution of claim 1, wherein the plurality of field electrodes or electrode portions configured to apply electromotive forces onto the transient majority charges further comprise:

field electrodes or electrode portions arranged within the transport path.

8. The system for synchronously driving a flame shape or heat distribution of claim 1, wherein the plurality of field electrodes or electrode portions configured to apply electromotive forces onto the transient majority charges further comprise:

field electrodes or electrode portions arranged peripheral to the transport path.

9. The system for synchronously driving a flame shape or heat distribution of claim 1, wherein the plurality of field electrodes or electrode portions configured to apply electromotive forces onto the transient majority charges further comprise:

one or more field electrodes or electrode portions disposed within the transport path; and one or more field electrodes or electrode portions disposed peripheral to the transport path.

10. The system for synchronously driving a flame shape or heat distribution of claim 1, wherein the applied electromotive forces on the transient majority charges are selected to impart momentum transfer onto uncharged gas particles or gas-entrained particles.

11. The system for synchronously driving a flame shape or heat distribution of claim 1, wherein the electrode controller is configured to cause the charge electrode to impart transient majority charges corresponding to a sequence of oppositely charged majority charge regions.

12. The system for synchronously driving a flame shape or heat distribution of claim 11, wherein the electrode controller is configured to apply sequences of voltages to the plurality of field electrodes or electrode portions to drive movement of the oppositely charged majority charge regions along the transport path.

13. The system for synchronously driving a flame shape or heat distribution of claim 11, wherein the electrode controller is configured to apply sequences of voltages to the plurality of field electrodes or electrode portions to drive movement of the sequence of oppositely charged majority charge regions along the transport path.

14. The system for synchronously driving a flame shape or heat distribution of claim 1, wherein the electrode controller further comprises:

a synchronous motor drive circuit configured to generate drive pulses corresponding to voltages applied to the plurality of field electrodes or electrode portions.

15. The system for synchronously driving a flame shape or heat distribution of claim 11, wherein the electrode controller further comprises:

one or more amplifiers configured to amplify drive pulses to voltages applied to the plurality of field electrodes or electrode portions.

16. The system for synchronously driving a flame shape or heat distribution of claim 15, wherein the one or more amplifiers include three amplifiers.

17. The system for synchronously driving a flame shape or heat distribution of claim 1, further comprising:

one or more sensors operatively coupled to provide one or more signals to the electrode controller;

wherein the one or more sensors are configured to sense one or more parameters corresponding to one or more of flame shape, heat distribution, combustion characteristic, particle content, or majority charged region location; and wherein the electrode controller is configured to select a timing, sequence, or timing and sequence of drive pulses corresponding to voltages applied to the charge electrode, the field electrode or electrode portions, or the charge electrode and the field electrode or electrode portions responsive to the one or more signals from the one or more sensors.

* * * * *